United States Patent [19]

Kofink

[11] 3,963,407

[45] June 15, 1976

[54] BURNER HAVING PHOTOELECTRICALLY OPERATED FUEL PUMP

[75] Inventor: Siegfried Kofink, Zell (Neckar), Germany

[73] Assignee: J. Eberspächer, Germany

[22] Filed: Mar. 24, 1975

[21] Appl. No.: 561,370

[30] Foreign Application Priority Data

Mar. 28, 1974 Germany ..... 2415012

[52] U.S. Cl. ..... 431/1; 431/18; 431/158; 431/353; 60/39.69; 60/39.28 R

[51] Int. Cl.[2] ..... F23C 3/02

[58] Field of Search ..... 431/1, 18, 158, 353

[56] References Cited

UNITED STATES PATENTS 3,610,782 10/1971 McGuire ..... 417/326

FOREIGN PATENTS OR APPLICATIONS 635,195 1/1962 Canada ..... 431/158

*Primary Examiner*—Carroll B. Dority, Jr.
*Attorney, Agent, or Firm*—McGlew and Tuttle

[57] ABSTRACT

A burner comprises means for directing combustion air into a combustion space for ignition with fuel which is directed into the space by an electromagnetic fuel pump which is operated off the shaft of a blower motor through the operation of a rotatably perforated disc which is rotated by the shaft to operate a photoelectric switching device for intermittently actuating the electromagnet of the fuel pump.

3 Claims, 3 Drawing Figures

BURNER HAVING PHOTOELECTRICALLY OPERATED FUEL PUMP

FIELD AND BACKGROUND OF THE INVENTION

This invention relates in general to the construction of burners and, in particular, to a burner which is operated with an electromagnetic fuel pump whose operation and speed is controlled by the movement of a disc which is rotatable by the fan motor of the burner.

DESCRIPTION OF THE PRIOR ART

The present invention is directed particularly to burners of a type which include a housing defining a combustion chamber which is supplied with combustion air by a rotatable blower and which is supplied with fuel by a fuel pump which is operated in timed relationship to the motor. Burners of this type are used in various applications, and a particular field of their use is in the heating of spaces, such as vehicle compartment spaces. When they are employed with motor vehicles, they constitute a part of a heating device which is independent of the engine of the vehicle and which may be operated independently of the engine to heat the interior of the vehicle. The life of such burners is determined by the life of the fuel pump which is used for feeding the fuel to a great degree. In the known burner constructions, the part susceptible to disturbances is the pulse generator for operating the fuel pump, which is subjected to a strong wear so that its long time resistance limit is too short. In addition, the known burners have the disadvantage that they fail to meet the standards of high performance burners in respect to the control of their operation and the fuel delivery into the combustion space. The susceptibility to disturbances of the known pulse generators for operating fuel pumps of this type is due to the use of mechanically actuated circuit breakers which break down after a certain service time.

In a known pulse generator, there is included an electromagnetic pump including an electromotor, a reduction gearing and a permanent magnet and a transistor. The permanent magnet is mounted on a worm gear driven by the electromotor and cooperates with a solenoid-operated switch which also controls the base of the transistor through which the electromagnetic dosing pump receives its impulses.

SUMMARY OF THE INVENTION

The present invention is directed to the construction of a burner which has a very long service life due to the use of a pulse generator which operates with extremely small wear. In accordance with the invention, the pulse generator comprises a perforated disc which is driven from the shaft of a rotatable fan motor through a gearing. The perforated disc is arranged between a photovoltaic cell and a photodiode which is arranged to direct light rays through the openings of the disc to the cell during rotation of the disc. During rotation of the disc, the path of the rays are interrupted with a frequency which depends on the rotatable speed of the shaft of the blower motor. This pulse interruption is used to supply current to an electromagnetic fuel pump which is thereby operated in a timed sequence to pump the fuel into the combustion chamber of the device. Such a construction is very rugged, and is exposed to only small wear, since only the gearing between the rotatable shaft of the blower and the perforated disc is subjected to any wearing. No mechanical load is applied because no interrupter is moved. By using a photoelectric light barrier in cooperation with a perforated disc, a pulse generating device is obtained which has a substantially unlimited operating life.

In a preferred form of the invention, it has been found advantageous to use an infrared light emitter as the photodiode, and to use a Darlington arrangement in place of a pure photovoltaic cell. The Darlington arrangement includes a receiver coupled with an amplifier and it makes it possible to use very small impulses for controlling the dosing pump with a high accuracy. The pulse duration and frequency can be determined in a particularly simple manner by selecting the design of the perforated disc and the opening sizes therein.

Accordingly, it is an object of the invention to provide a burner which includes an electromagnetic fuel pump for supplying fuel to a combustion space and which is operated by a photoelectric switch which emits a periodic impulse to an electromagnetic fuel pump so that the fuel is delivered in timed relationship to the rotation of the shaft of a blower motor.

A further object of the invention is to provide a device for operating an electromagnetic fuel pump which includes a rotatable perforated disc which is adapted to be driven by a driving motor of a burner assembly and which includes a light supply and a receiving photoelectric cell arranged on respective sides thereof so that the photocell is energized and receives light from the light source through the perforations in intermittent manner during the rotation of the disc and this intermittent pulsing is used to operate the electromagnetic fuel pump.

A further object of the invention is to provide a burner which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
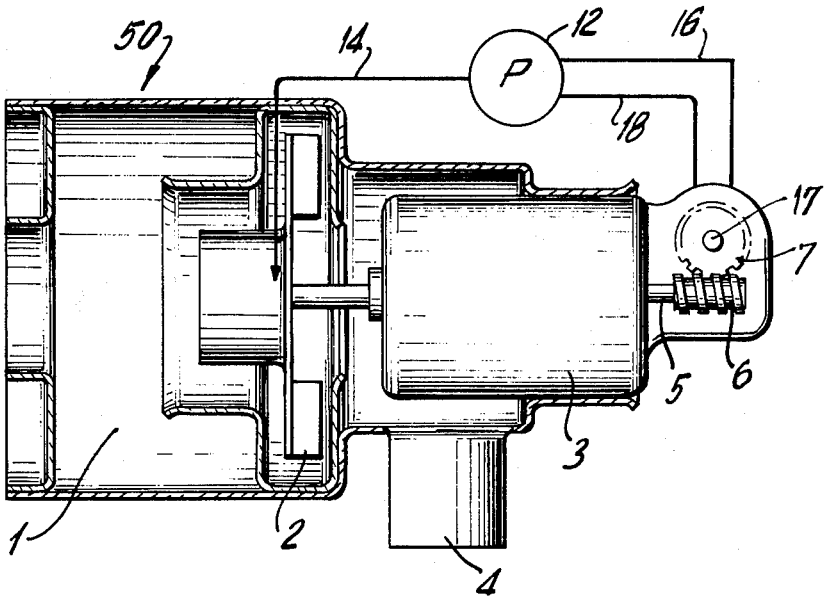
FIG. 1 is a partial diagrammatic sectional view of a burner constructed in accordance with the invention.
Figure 2:
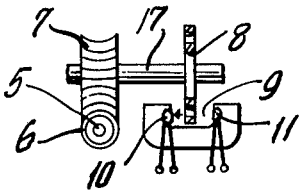
FIG. 2 is a partial side elevational view showing the photocell arrangement for operating the fuel pump.

Referring to the drawing in particular, the invention embodied therein, comprises a housing, generally designated 50, defining an interior combustion chamber or space 1, having an air inlet 4 for supplying combustion air to the space. A fan drive motor 3 drives a fan or blower 2 to bring the combustion air into the inlet 4 to combustion chamber 1. An electromagnetic fuel pump 12 has a discharge 14 connected into combustion chamber 1, and it is operated intermittently by pulses received from an electric power circuit supply line 16 to pump liquid fuel from an inlet 18 through discharge 14 to combustion chamber 1.

In accordance with the invention, the drive shaft of motor 3 includes a rearward extension 5 having a worm 6 which rotates a worm gear 7 of a shaft 17 and, thereby, rotates a perforated disc 8 affixed to shaft 17. In accordance with the invention, a photoelectric switch is operated by rotation of perforated disc 8 to energize a power circuit, generally designated 20, which is connected through a line 16 having an electromagnet 16' of the pump, generally designated 12.

Perforated disc 8 projects into space 9 between a photodiode 10 and a photovoltaic cell 11, so that the path of rays from the diode to the cell must pass through openings of perforated disc 8 when these openings are aligned with the cell and which openings are intermittently blocked by rotation of the disc. It is particularly favorable to design the photodiode 10 as an infrared emitter and the photovoltaic cell 11 in a Darlington arrangement, that is, as a receiver, combined with an amplifier. The intermittent pulses which are produced and directed to the electric magnet 16' causes a pulsing of the fuel pump and a pumping of the fuel and the speed of operation of the pump, therefore, will depend upon the rotational speed of disc 8.

Figure 3:
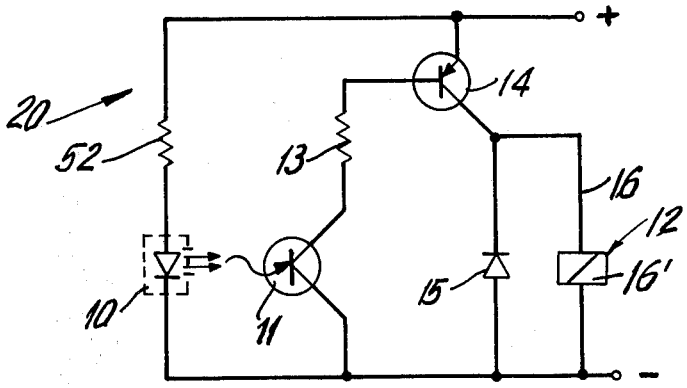
FIG. 3 is a schematic wiring diagram of the fuel pump switching circuit.

As shown in FIG. 3, circuit 20 also includes a resistance 52 for the photodiode 10, a resistance 13 for the photovoltaic cell 11, and a transistor 14 and a diode 15.

While a specific embodiment of the invention has been shown and described in detail to illustrate the application of the principles of the invention, it will be understood that the invention may be embodied otherwise without departing from such principles.

What is claimed is:

1. A burner, comprising means defining a combustion space, combustion air inlet means connected to said combustion space, a blower associated with said inlet means, a drive motor connected to said blower to rotate said blower and having a blower shaft, a rotatable perforated timing member connected to said blower shaft for rotation thereby in timed relationship to said blower shaft, an electromagnetic fuel pump having a fuel discharge connected to said combustion space and having an electromagnet which is energized periodically to operate said pump, an electric supply circuit connected to said electromagnet, and a photocell switch in said electric supply circuit including a photodiode arranged on one side of said perforated timing member and a photovoltaic cell on the opposite side aligned with said photodiode and positioned to receive the rays from said photodiode through the perforations of said timing member intermittently during the rotation of said timing member and to intermittently operate said pump thereby.

2. A burner according to claim 1, including gearing in the connection between said motor drive shaft and said perforated timing member.

3. A burner according to claim 1, wherein said photodiode comprises an infrared emitter, said photovoltaic cell comprising a Darlington arrangement.

* * * * *